US006164943A

United States Patent [19]

Arbogast et al.

[11] Patent Number: 6,164,943

[45] Date of Patent: Dec. 26, 2000

[54] INTERNAL GEARED WHEEL PUMP WITHOUT CRESCENT-SHAPED [SICKLE] PIECE

[75] Inventors: Franz Arbogast; Peter Peiz, both of Heidenheim, Germany

[73] Assignee: Voith Turbo GmbH & Co., KG, Heidenheim, Germany

[21] Appl. No.: 09/241,125

[22] Filed: Feb. 1, 1999

[30] Foreign Application Priority Data

Feb. 3, 1998 [DE] Germany ..... 198 04 133

[51] Int. Cl.[7] ..... F04C 2/00

[52] U.S. Cl. ..... 418/168; 418/124; 418/116; 418/140; 74/462

[58] Field of Search ..... 418/168, 124, 418/116, 140; 74/462

[56] References Cited

U.S. PATENT DOCUMENTS

| | | | |
|---|---|---|---|
| 1,993,721 | 3/1935 | Pigott | 418/168 |
| 2,669,904 | 2/1954 | Bloomfield et al. | 90/1.6 |
| 2,845,031 | 7/1958 | Guibert . | |
| 2,925,044 | 2/1960 | Brundage | 418/168 |
| 4,813,858 | 3/1989 | Otto et al. . | |
| 5,711,660 | 1/1998 | Mitarai et al. . | |
| 5,845,533 | 12/1998 | Basstein et al. | 74/462 |
| 5,890,885 | 4/1999 | Eckerle | 418/168 |

FOREIGN PATENT DOCUMENTS

| | | | |
|---|---|---|---|
| 315 878 | 5/1989 | European Pat. Off. . | |
| 0 607 497 A1 | 7/1994 | European Pat. Off. . | |
| 607 497 | 7/1994 | European Pat. Off. . | |
| 000848165A2 | 6/1998 | European Pat. Off. | 418/168 |
| 3417824 | 11/1985 | Germany . | |
| 356047692 | 4/1981 | Japan | 418/168 |
| 7-102928 | 4/1995 | Japan . | |

*Primary Examiner*—Thomas Denion
*Assistant Examiner*—Thai-Ba Trieu
*Attorney, Agent, or Firm*—Ohlandt, Greeley, Ruggiero & Perle, L.L.P.

[57] ABSTRACT

An internal geared wheel pump that does not have a crescent shaped piece. The pump has an internal geared wheel that meshes with a pinion. The pinion and geared wheel are mounted in a rotatable manner in a housing that has a suction connection and a pressure connection. The geared wheel has passages that produce each time a conductive connection between the base of the tooth and the envelope surface of the geared wheel. Conductive connections are produced between the bearing flanks of the teeth of the geared wheel or the teeth of the pinion and the radial boreholes of the geared wheel.

6 Claims, 2 Drawing Sheets

3.1
1.3
1
1.1
1.2
2
2.1
2.2
3
3.2
X

INTERNAL GEARED WHEEL PUMP WITHOUT CRESCENT-SHAPED [SICKLE] PIECE

The invention concerns an internal geared wheel pump without crescent-shaped [sickle] piece, as described, for example, in EP 0 607,497 B1.

Such pumps have as essential elements an external toothed pinion, an internal geared wheel, which meshes with the pinion, as well as a housing, which has a suction connection and a pressure connection and which takes up both of the named gearing [toothed] elements.

The geared wheel has radial boreholes. Each one of these produces a conductive connection between the respective base of the tooth of the geared wheel and its outer periphery. The boreholes serve for the purpose of allowing medium to enter in the region of the suction connection via the geared wheel to penetrate the intermediate space between the geared wheel and the pinion, and in the region of the pressure connection to reach from the named intermediate space via the geared wheel the pressure connection.

Various requirements are placed on such internal geared wheel pumps. Thus, the seal between the teeth of the geared wheel and the teeth of the pinion must be as perfect as possible in the region of the pressure buildup. There should only be a slight wear. The pump will operate in a reproducible manner, so that it continually transports the same quantity of medium at the same pressure, even for longer periods of time at specific rpm's. Finally, the pump must be manufactured in a cost-favorable manner.

It has been shown that the seal between the teeth is not always optimal in the region of the pressure buildup, so that the transport performance fluctuates over longer periods of time.

The invention takes on the task of providing an internal geared wheel pump without crescent-shaped [sickle] piece, which brings about an optimal operating performance in any relation, is simple in structure and exhibits small wear.

The inventor has recognized that oil crushings can occur in the region of the bearing flanks of the gear teeth. These may adversely effect the efficiency to a considerable extent. In order to eliminate these oil crushings, conductive connections are provided according to the invention between the spaces in question and the respective axial boreholes in the geared wheel.

This task is resolved by the features of claim 1.

The invention is explained in more detail on the basis of the drawing. Here, taken individually, the following is shown:

Figure 1:
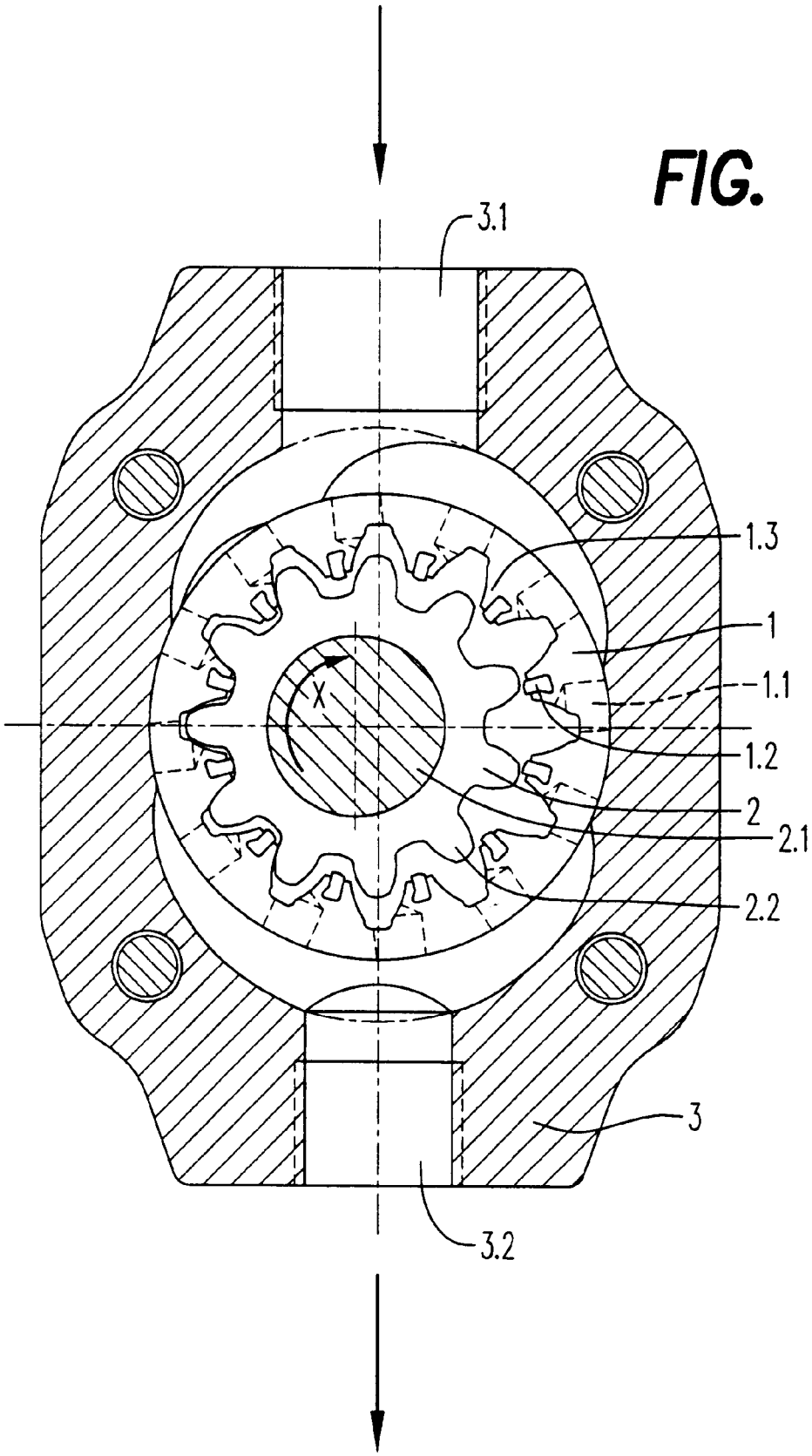
FIG. 1 shows an internal geared wheel pump without crescent-shaped [sickle] piece in an axial section.

The internal geared wheel pump shown in FIG. 1 is one with a head seal and without a crescent-shaped [sickle] piece. It comprises as essential elements a geared wheel 1, a pinion 2, as well as a housing 3. Geared wheel 1 is provided with boreholes 1.1. These produce a conductive connection between the surroundings (envelope or outer surface) of geared wheel 1 on the one hand and the intermediate space between geared wheel 1 and pinion 2 on the other hand. Sealing elements 1.2 are inserted into the teeth of the geared wheel each time.

Pinion 2 is wedged onto a pinion shaft 2.1, which rotates in the direction of arrow X.

Housing 3 has a suction connection 3.1 and a pressure connection 3.2.

Teeth 1.3 of the geared wheel and teeth 2.2 of the pinion have an axial width that is greater than the pitch circle diameter of pinion 2. Geared wheel 1 and pinion 2 are mounted eccentrically to one another. In addition, the number of teeth 2.2 of pinion 2 is one less than the number of teeth 1.3 of geared wheel 1.

Figure 2:
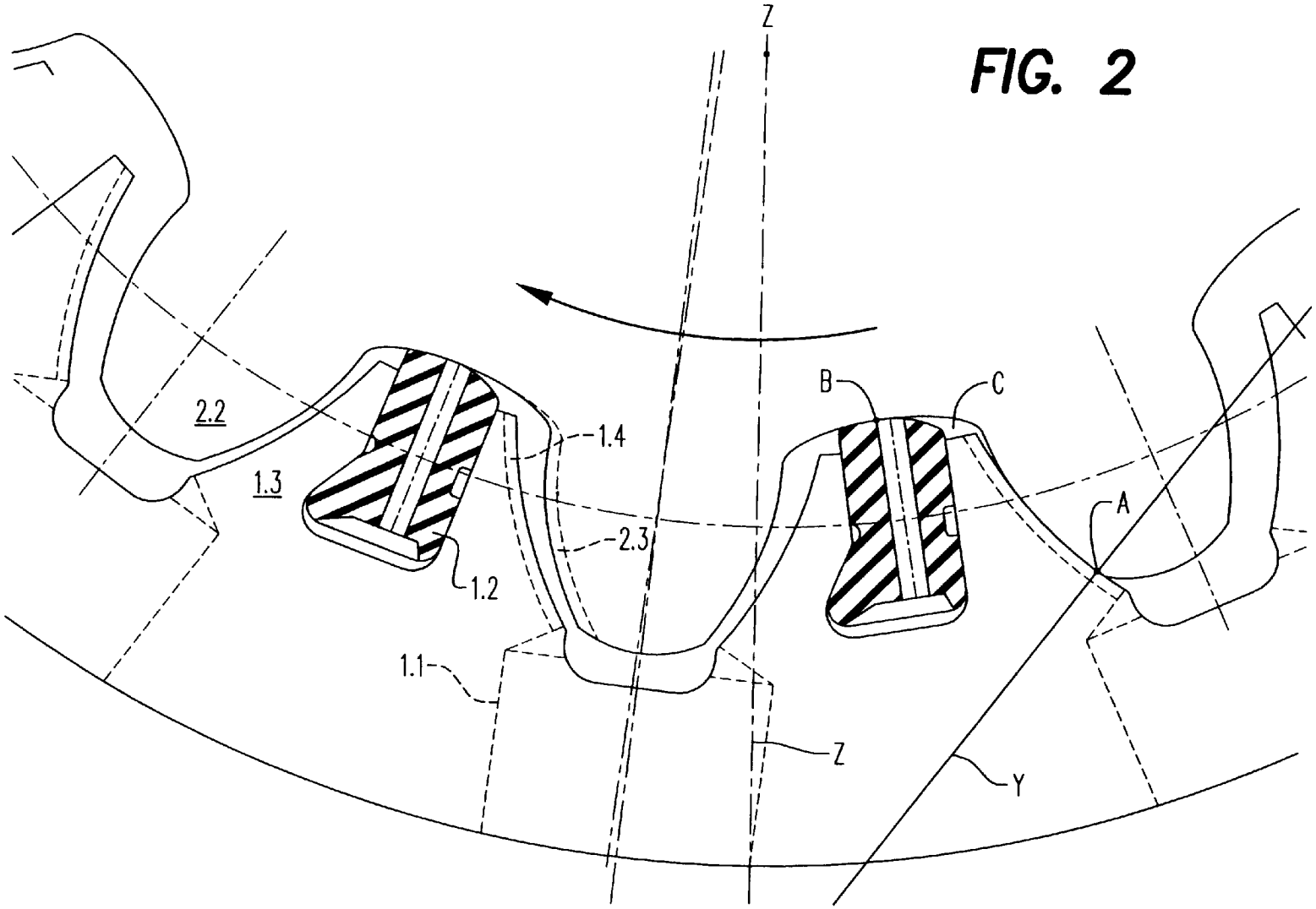
FIG. 2 shows the internal geared wheel pump according to FIG. 1 in a first form of embodiment.

The form of embodiment shown in FIG. 2 shows the ratios in the region of the pressure buildup in front of and behind dead point Z. Again one recognizes teeth 1.3 of the geared wheel and teeth 2.2 of the pinion, and additionally the connection boreholes 1.1 in the geared wheel as well as sealing elements 1.2 in the heads of teeth 1.3 of the geared wheel.

The inventors have recognized the following: This arrangement can lead to an oil crushing in the intermediate space C in the region of the head of each tooth 1.3 of the geared wheel and of each tooth foot of pinion 2. This oil crushing occurs in the region between points A and B. Point A lies on the line of action Y and point B lies at a contact place between sealing element 1.2 and the foot of pinion teeth 2.2. In order to provide relief here, grooves are provided according to the invention, i.e., either grooves 1.4 in the flanks of teeth 1.3 of the geared wheel, or grooves 2.3 in the flanks of pinion teeth 2.2. The grooves lead to an unloading [relief] of the named space. They represent a conductive connection between the space C in question and the respective radial borehole 1.1 in geared wheel 1.

If the axial line of teeth 1.3 and 2.2 is small, then it is sufficient to bezel the tooth flanks in the region of the front sides, instead of providing grooves.

What is claimed:

1. An internal geared wheel pump without crescent-shaped piece, said pump comprising:

an internal geared wheel having a plurality of gear teeth, each of said plurality of gear teeth having a base and a bearing flank;

a pinion having a plurality of pinion teeth, each of said plurality of pinion teeth having a base and a bearing flank, said plurality of pinion teeth meshing with said plurality of gear teeth;

said pinion and said geared wheel being mounted for rotation in a housing that has a suction connection and a pressure connection;

said geared wheel having a plurality of radial passages, each of said plurality of radial passages producing a conductive connection between the base of one of said plurality of gear teeth and an envelope surface of said geared wheel; and wherein said conductive connections are produced between the bearing flanks of said plurality of gear teeth of said geared wheel or said plurality of pinion teeth of said pinion and said radial passages of said geared wheel.

2. An internal geared wheel pump according to claim 1, wherein the conductive connections are provided both in the bearing flanks of said plurality of gear teeth of said geared wheel and in the bearing flanks of said plurality of pinion teeth of said pinion.

3. An internal geared wheel pump according to claim 1, wherein the conductive connections have a plurality of grooves that extend at least over a part of the length of the flanks.

4. An internal geared wheel pump according to claim 3, wherein said plurality of grooves extend over the entire flank length of the teeth.

5. An internal geared wheel pump according to claim 3, wherein several of said plurality of grooves lie axially next to one another in each flank.

6. An internal geared wheel pump according to claim 5, wherein a plurality of bezels are provided for producing said conductive connections in an edge region of the bearing flanks of said plurality of gear teeth or said plurality of pinion teeth.

* * * * *